US010105954B2

(12) United States Patent
Murashima et al.

(10) Patent No.: US 10,105,954 B2
(45) Date of Patent: Oct. 23, 2018

(54) INKJET RECORDING DEVICE

(71) Applicant: KYOCERA Document Solutions Inc., Osaka (JP)

(72) Inventors: Masaki Murashima, Osaka (JP); Yasuyuki Fukunaga, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/828,535

(22) Filed: Dec. 1, 2017

(65) Prior Publication Data

US 2018/0154638 A1 Jun. 7, 2018

(30) Foreign Application Priority Data

Dec. 2, 2016 (JP) ..... 2016-234947

(51) Int. Cl.
*B41J 2/165* (2006.01)

(52) U.S. Cl.
CPC ..... *B41J 2/16547* (2013.01); *B41J 2/16508* (2013.01); *B41J 2/16511* (2013.01); *B41J 2/16538* (2013.01); *B41J 2/16585* (2013.01); *B41J 2002/16591* (2013.01)

(58) Field of Classification Search
CPC ..... B41J 2/16547; B41J 2/16508; B41J 2/16511; B41J 2/04581
USPC ..... 347/20, 22, 29, 32
See application file for complete search history.

(56) References Cited

U.S. PATENT DOCUMENTS 8,201,917 B2 * 6/2012 Ito ..... B41J 2/04581 347/10
8,636,338 B2 * 1/2014 Mealy ..... B41J 2/16505 347/20
2009/0085966 A1 * 4/2009 Umeda ..... B41J 2/16511 347/32

FOREIGN PATENT DOCUMENTS

JP 2001-293871 A 10/2001

* cited by examiner

*Primary Examiner* — An Do
(74) *Attorney, Agent, or Firm* — Studebaker & Brackett PC

(57) ABSTRACT

An inkjet recording device includes a recording head section, a capping unit, a capping movement mechanism, and a capping support section. The recording head section forms an image with ink on paper. The capping unit includes a cap that is contactable to the recording head section. The capping movement mechanism moves the capping unit. The capping support section supports the capping unit. The capping movement mechanism includes a rail section which guides the capping unit in a Y axial direction between standby and retracted positions. The capping support section includes a rail section which guides the capping unit in an X axial direction between the standby position and a detachable position.

9 Claims, 7 Drawing Sheets

INKJET RECORDING DEVICE

INCORPORATION BY REFERENCE

The present application claims priority under 35 U.S.C. § 119 to Japanese Patent Application No. 2016-234947, filed on Dec. 2, 2016. The contents of this application are incorporated herein by reference in their entirety.

BACKGROUND

The present disclosure relates to inkjet recording devices.

An existing inkjet printer includes a line head, a head cap, and a head frame. The line head forms images on paper with ink. The head cap moves from an open position to a closed position, closing the line head. The head frame guides the head cap between the closed and open positions. In the inkjet printer, the head cap moves between the closed and open positions in a left-right direction of the inkjet printer.

The head cap is taken out of the inkjet printer when the head cap is replaced. In a configuration in which the head cap moves in the left-right direction of the inkjet printer, the head cap may be taken out through an opening disposed in either a left or right side surface of the inkjet printer. The opening, for example, is on a side surface with an exit port thereon. A recording medium is ejected through the exit port.

SUMMARY

An inkjet recording device according to an aspect of the present disclosure includes a recording head section, a capping unit, a capping movement mechanism, and a capping support section. The recording head section forms an image with ink on a recording medium. The capping unit includes a cap that is contactable to the recording head section. The capping movement mechanism moves the capping unit. The capping support section supports the capping unit. The capping movement mechanism includes a first horizontal guidance section which guides the capping unit in a first horizontal direction between a standby position in which the cap is located beneath the recording head section and a retracted position in which the cap has retracted from the standby position. The capping support section includes a second horizontal guidance member which guides the capping unit in a second horizontal direction between the standby position and a detachable position in which the capping unit is attached or detached. The second horizontal direction intersects the first horizontal direction.

DETAILED DESCRIPTION

Figure 1:
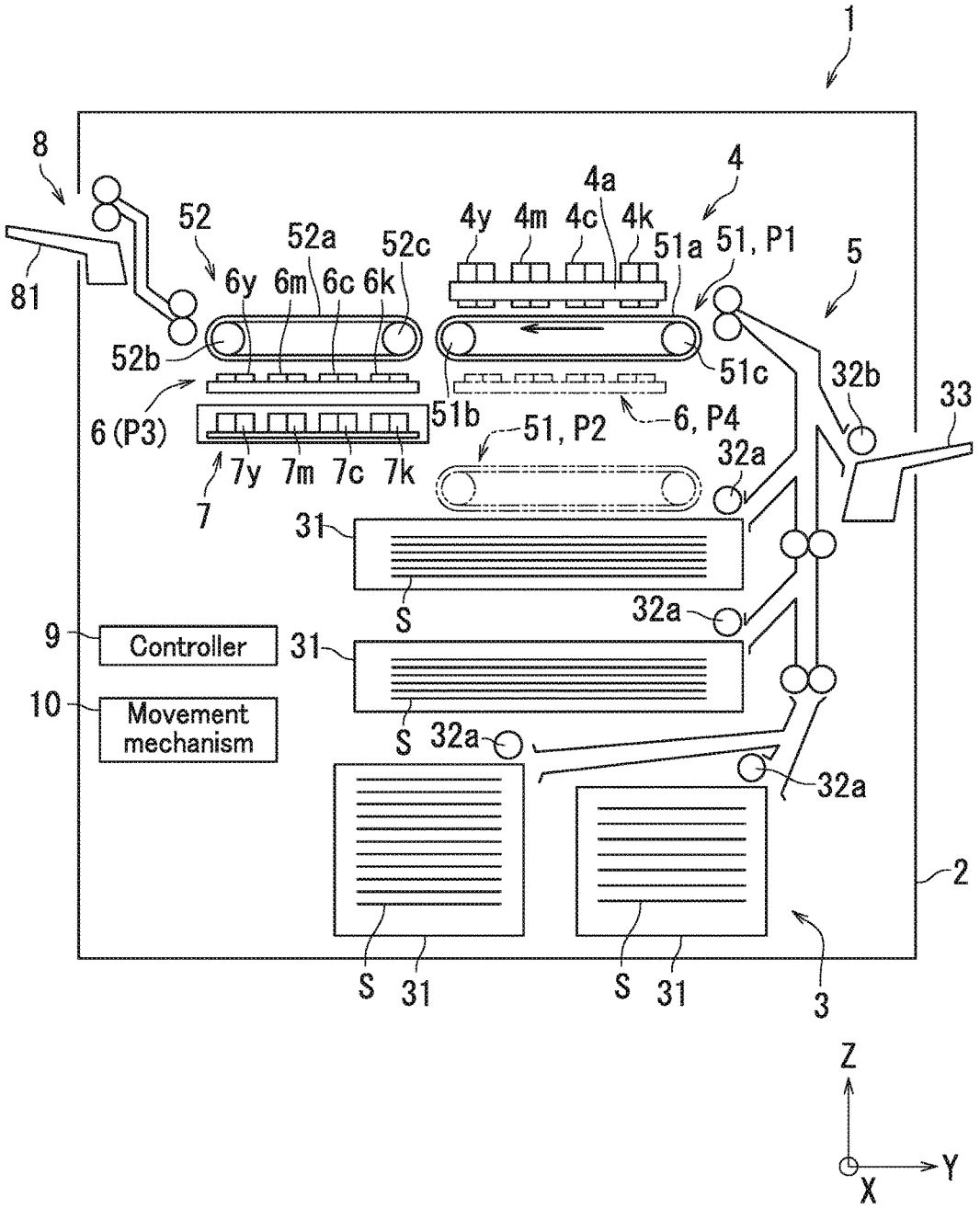
FIG. 1 is a diagram illustrating a configuration of an inkjet recording device according to an embodiment of the present disclosure.

As follows, an inkjet recording device 1 according an embodiment of the present disclosure is described with reference to the drawings. Note that elements that are the same or equivalent are indicated by the same reference signs in the drawings and description thereof is not repeated. Also, the drawings are schematic illustrations that emphasize elements of configuration in order to facilitate understanding thereof.

The inkjet recording device 1 according to the embodiment of the present disclosure is described with reference to FIG. 1. FIG. 1 is a diagram illustrating a configuration of the inkjet recording device 1 according to the embodiment of the present disclosure. X, Y, and Z axes in the diagrams are orthogonal to each other. Also, the X and Y axes are parallel to a horizontal plane, and the Z axis is parallel to a vertical line. A Y axial direction is an example of a first horizontal direction according to an aspect of the present disclosure, and an X axial direction is an example of a second horizontal direction according to an aspect of the present disclosure.

As illustrated in FIG. 1, the inkjet recording device 1 includes a casing 2, a paper feed section 3, a recording head section 4, a conveyance section 5, a capping unit 6, a wiper section 7, an ejection section 8, a controller 9, and a movement mechanism 10. The paper feed section 3, the recording head section 4, the conveyance section 5, the capping unit 6, the wiper section 7, the controller 9, and the movement mechanism 10 are housed inside of the casing 2. The ejection section 8 is partially housed inside of the casing 2.

The paper feed section 3 includes paper feed cassettes 31, paper feed rollers 32*a* and 32*b*, and a manual feed tray 33. The paper feed cassettes 31 are arranged in a lower portion of the casing 2. The paper feed cassettes 31 are attachable to and detachable from the casing 2. Multiple sheets of paper S can be stacked and accommodated inside of the paper feed cassettes 31. A portion of the manual feed tray 33 is externally exposed from the casing 2. Multiple sheets of the paper S can be stacked and placed on the manual feed tray 33.

The paper S is an example of a recording medium according to an aspect of the present disclosure. The paper S is plain paper, copy paper, recycled paper, thin paper, thick paper, glossy paper, or overhead projector (OHP) transparency, for example.

The paper feed rollers 32*a* and 32*b* are so-called pickup rollers. The paper feed rollers 32*a* retrieve an uppermost sheet of the paper S housed within the paper feed cassettes 31 one sheet at a time. The paper feed roller 32*b* retrieves an uppermost sheet of the paper S placed on the manual feed tray 33 one sheet at a time. The paper feed rollers 32*a* and 32*b* send the retrieved paper S to the conveyance section 5.

The conveyance section 5 conveys the paper S along a conveyance path of the paper S. The conveyance path of the paper S extends from the paper feed section 3 to the ejection section 8 via the recording head section 4. The conveyance section 5 includes a first conveyance unit 51, a second conveyance unit 52, and a plurality of roller pairs arranged along the conveyance path.

The first conveyance unit 51 is an example of a conveyance unit according to an aspect of the present disclosure. The first conveyance unit 51 includes a conveyor belt 51*a*, a drive roller 51*b*, and a driven roller 51*c*. The conveyor belt 51*a* is wound between the drive roller 51*b* and the driven roller 51*c*. The paper S conveyed by the conveyor belt 51*a* is sent to the second conveyance unit 52 by rotation of the conveyor belt 51*a*.

The second conveyance unit 52 is arranged downstream from the first conveyance unit 51 in the conveyance path. The second conveyance unit 52 includes a conveyor belt 52*a*, a drive roller 52*b*, and a driven roller 52*c*. The conveyor belt 52*a* is wound between the drive roller 52*b* and the driven roller 52*c*. The paper S conveyed by the conveyor belt 52*a* is sent to the ejection section 8 by rotation of the conveyor belt 52*a*.

The recording head section 4 is arranged facing the first conveyance unit 51. The recording head section 4 forms images with ink on the paper S conveyed by the first conveyance unit 51. The paper S with images formed thereon is sent to the second conveyance unit 52.

The recording head section 4 includes a head housing 4*a* and recording heads 4*y*, 4*m*, 4*c*, and 4*k*. The head housing 4*a* holds the recording heads 4*y*, 4*m*, 4*c*, and 4*k*. The recording head 4*y* ejects yellow ink. The recording head 4*m* ejects magenta ink. The recording head 4*c* ejects cyan ink. The recording head 4*k* ejects black ink.

The ejection section 8 includes an exit tray 81. A portion of the exit tray 81 is externally exposed from the casing 2. The paper S with images formed thereon is ejected to the exit tray 81. Note that sheets of the paper S with images formed thereon are sequentially stacked on the exit tray 81.

The wiper section 7 is arranged beneath the second conveyance unit 52. The wiper section 7 includes wiper blades 7*y*, 7*m*, 7*c*, and 7*k*. The wiper blades 7*y*, 7*m*, 7*c*, and 7*k* wipe attached ink off of the recording head section 4. The wiper blade 7*y* corresponds to the recording head 4*y*. The wiper blade 7*m* corresponds to the recording head 4*m*. The wiper blade 7*c* corresponds to the recording head 4*c*. The wiper blade 7*k* corresponds to the recording head 4*k*.

The capping unit 6 is arranged beneath the second conveyance unit 52 and above the wiper section 7. The capping unit 6 includes caps 6*y*, 6*m*, 6*c*, and 6*k*. The cap 6*y* corresponds to the recording head 4*y*. The cap 6*m* corresponds to the recording head 4*m*. The cap 6*c* corresponds to the recording head 4*c*. The cap 6*k* corresponds to the recording head 4*k*.

The capping unit 6, for example, affixes the caps 6*y*, 6*m*, 6*c*, and 6*k* to the recording heads 4*y*, 4*m*, 4*c*, and 4*k*, respectively. This is done when the recording head section 4 goes unused for more than a predetermined amount of time. As a result, the ink of the recording heads 4*y*, 4*m*, 4*c*, and 4*k* is inhibited from drying.

The movement mechanism 10 moves the first conveyance unit 51, the capping unit 6, and the wiper section 7 inside of the casing 2. The movement mechanism 10 moves the first conveyance unit 51 between an upper limit position P1 and a lower limit position P2. In the upper limit position P1, the first conveyance unit 51 is facing the recording head section 4. In the lower limit position P2, the first conveyance unit 51 is descended from the upper limit position P1. When in the lower limit position P2, the first conveyance unit 51 does not make contact with either the capping unit 6 in a standby position P4 or the wiper section 7 in a standby position. In the standby position P4, the caps 6*y*, 6*m*, 6*c*, and 6*k* are located beneath the recording head section 4.

The movement mechanism 10 moves the capping unit 6 between a retracted position P3 and the standby position P4. The capping unit 6 faces the recording head section 4 in a Z axial direction (up-and-down direction) when in the standby position P4. The capping unit 6 is located beneath the second conveyance unit 52 when in the retracted position P3. In the retracted position P3, the caps 6*y*, 6*m*, 6*c*, and 6*k* are retracted from the standby position P4.

The movement mechanism 10 moves the wiper section 7 between a retracted position (indicated by solid lines in FIG. 1) and a standby position. The wiper section 7 faces the recording head section 4 in the Z axial direction (up-and-down direction) when in the standby position. The wiper section 7 is located beneath the second conveyance unit 52 when in the retracted position.

The controller 9 controls operation of the inkjet recording device 1. In detail, the controller 9 includes a central processing unit (CPU) and memory. Various computer programs to be executed by the CPU are stored in the memory. The CPU controls the paper feed section 3, the recording head section 4, the conveyance section 5, the capping unit 6, the wiper section 7, and the movement mechanism 10 by executing the various computer programs stored in the memory.

Figure 2:
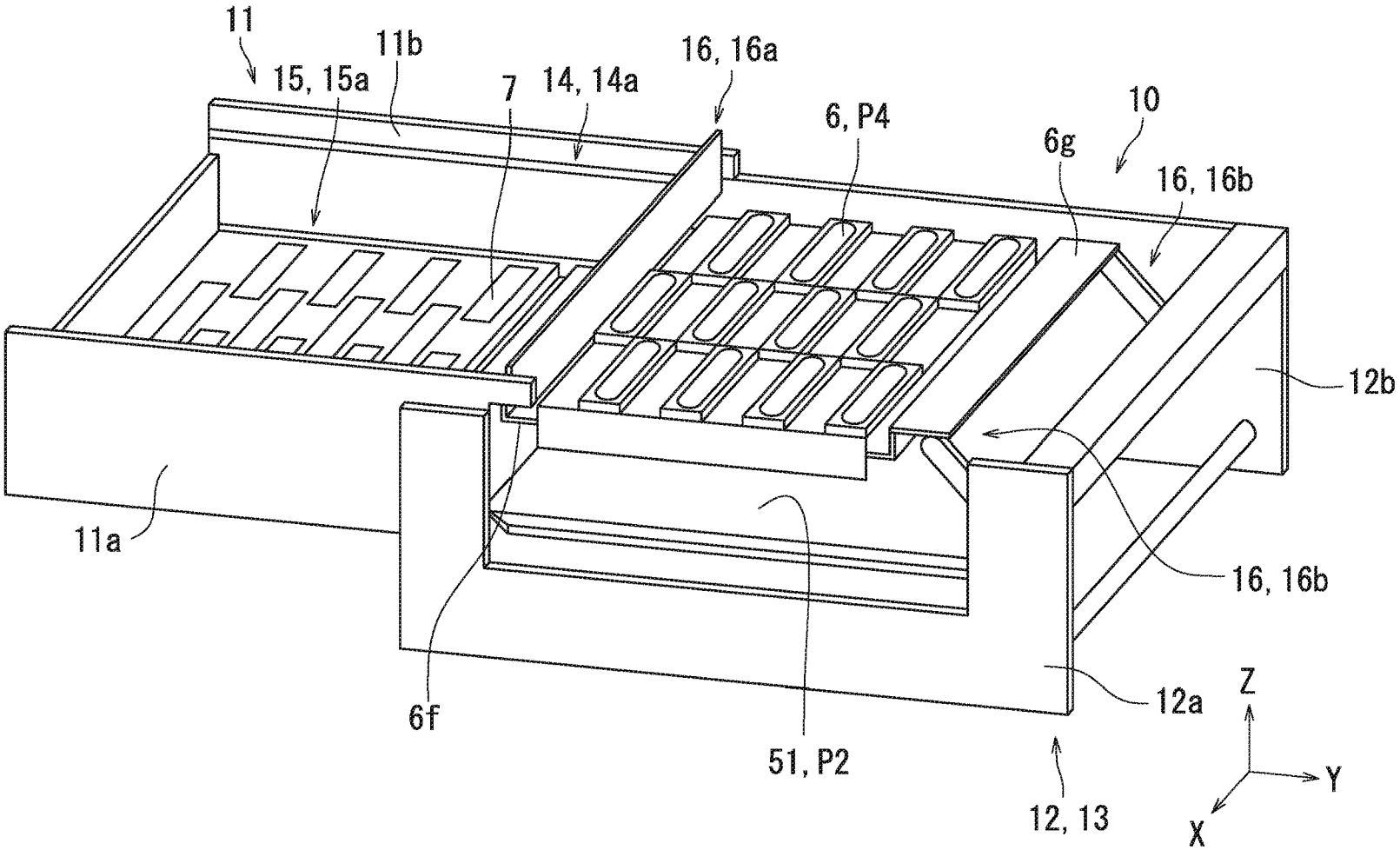
FIG. 2 is a perspective view illustrating a movement mechanism according to the embodiment of the present disclosure.
Figure 3:
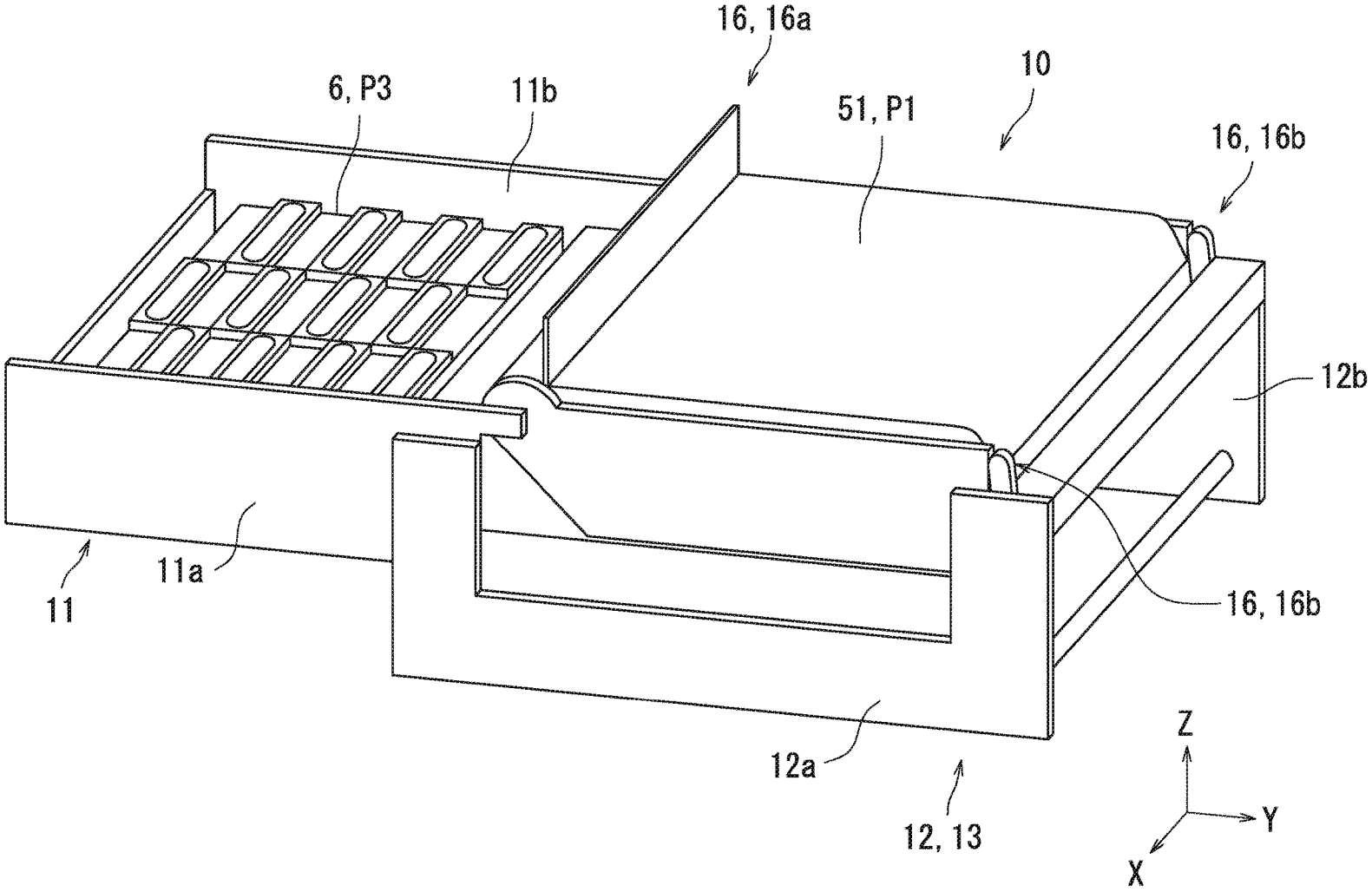
FIG. 3 is another perspective view illustrating the movement mechanism according to the embodiment of the present disclosure.

A configuration of the movement mechanism 10 is described with reference to FIGS. 2 and 3. FIGS. 2 and 3 are perspective views illustrating the movement mechanism 10. In detail, in the movement mechanism 10 illustrated in FIG. 2, the first conveyance unit 51 is in the lower limit position P2, the capping unit 6 is in the standby position P4, and the wiper section 7 is in the retracted position. In the movement mechanism 10 illustrated in FIG. 3, the first conveyance unit 51 is in the upper limit position P1, the capping unit 6 is in the retracted position P3, and the wiper section 7 is in the retracted position. Note that in FIG. 3, the wiper section 7 is hidden by the capping unit 6 and therefore not shown.

As illustrated in FIGS. 2 and 3, the movement mechanism 10 includes a first casing 11, a second casing 12, a conveyance unit movement mechanism 13, a capping movement mechanism 14, and a wiper movement mechanism 15.

The first casing 11 includes walls 11*a* and 11*b* facing each other in the X axial direction (front-back direction of the inkjet recording device 1). The walls 11*a* and 11*b* movably support the capping unit 6. The walls 11*a* and 11*b* also movably support the wiper section 7.

The second casing 12 includes walls 12*a* and 12*b* facing each other in the X axial direction. The walls 12*a* and 12*b* movably support the first conveyance unit 51.

The conveyance unit movement mechanism 13 causes the first conveyance unit 51 to ascend or descend in the Z axial direction inside of the second casing 12. The conveyance unit movement mechanism 13 is configured with a rail section and an engagement section, for example. The rail section is on the inner surfaces of the walls 12*a* and 12*b*, oriented in an up-and-down direction, for example. The engagement section is in the first conveyance unit 51. The engagement section slides up and down along the rail section.

The wiper movement mechanism 15 moves the wiper section 7 in the Y axial direction between the standby and retracted positions. The wiper movement mechanism 15 is configured with a rail section 15*a* and an engagement pin, for example. The rail section 15*a* is on the inner surfaces of the walls 11*a* and 11*b*, oriented in the Y axial direction, for example. The engagement pin is disposed on a side surface of the wiper section 7. The engagement pin is guided in the Y axial direction by the rail section 15*a*. The engagement pin slides along the rail section 15*a*, and guides the wiper section 7 in the Y axial direction between the retracted and standby positions. A drive source such as a motor is used to move the wiper section 7, for example.

The capping movement mechanism 14 moves the capping unit 6 in the Y axial direction between the standby and retracted positions P4 and P3. The capping movement mechanism 14 is an example of a first horizontal guidance section according to an aspect of the present disclosure.

The capping movement mechanism 14 includes a rail section 14*a* and an engagement pin, for example. The rail section 14*a* is on the inner surfaces of the walls 11*a* and 11*b*, oriented in the Y axial direction, for example. The engagement pin is disposed on a side surface of the capping unit 6. The engagement pin is guided in the Y axial direction by the rail section 14*a*. The engagement pin slides along the rail section 14*a* and guides the capping unit 6 in the Y axial direction between the retracted and standby positions P3 and P4. A drive source such as a motor is used to move the capping unit 6, for example.

The movement mechanism 10 further includes a capping support section 16. The capping support section 16 supports the capping unit 6 that has been moved into the standby position P4. As a result, the capping unit 6 is restricted from moving downward when in the standby position P4. The capping support section 16 includes a rail section 16*a* and two support lever sections 16*b*.

The rail section 16*a* engages the capping unit 6 when the capping unit 6 has been moved into the standby position P4, and supports the capping unit 6 inside of the second casing 12. The rail section 16*a* is an example of a second horizontal guidance section according to an aspect of the present disclosure. The rail section 16*a* engages one end (left end in FIG. 2) of the capping unit 6 in the Y axial direction. The one end of the capping unit 6 in the Y axial direction includes an engagement rail section 6*f* engaging the rail section 16*a*.

The support lever sections 16*b* support the capping unit 6 inside of the second casing 12 when the capping unit 6 has been moved into the standby position P4. The support lever sections 16*b* support the other end (right end in FIG. 2) of the capping unit 6 in the Y axial direction from beneath. The capping unit 6 includes a plate section 6*g* on the other end thereof in the Y axial direction, the plate section 6*g* being supported from beneath by the support lever sections 16*b*.

Figure 4A:
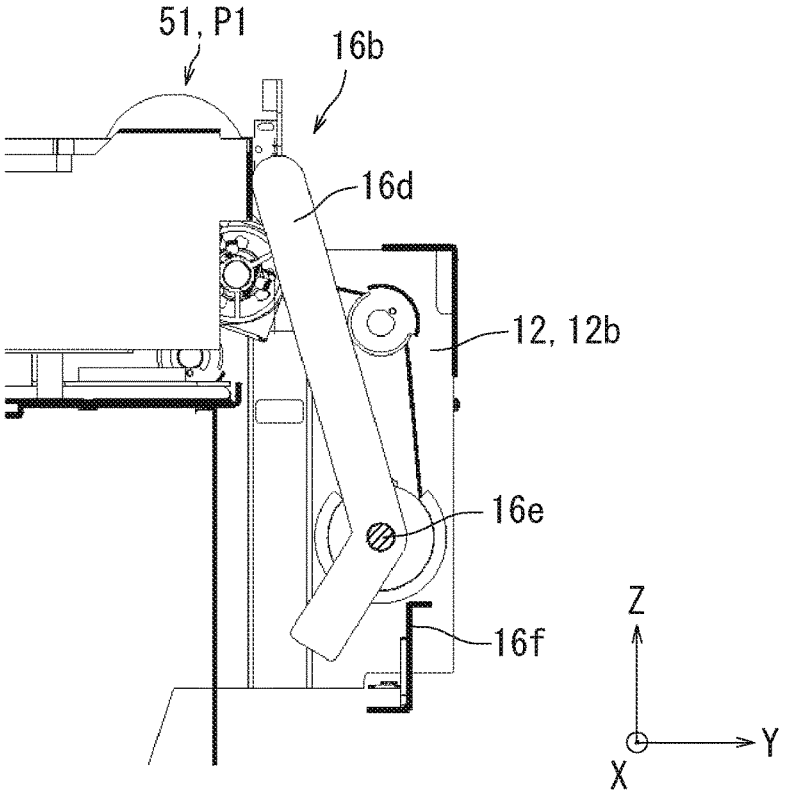
FIG. 4A is a side view illustrating a support lever section when a first conveyance unit according to the embodiment of the present disclosure is in an upper limit position.
Figure 4B:
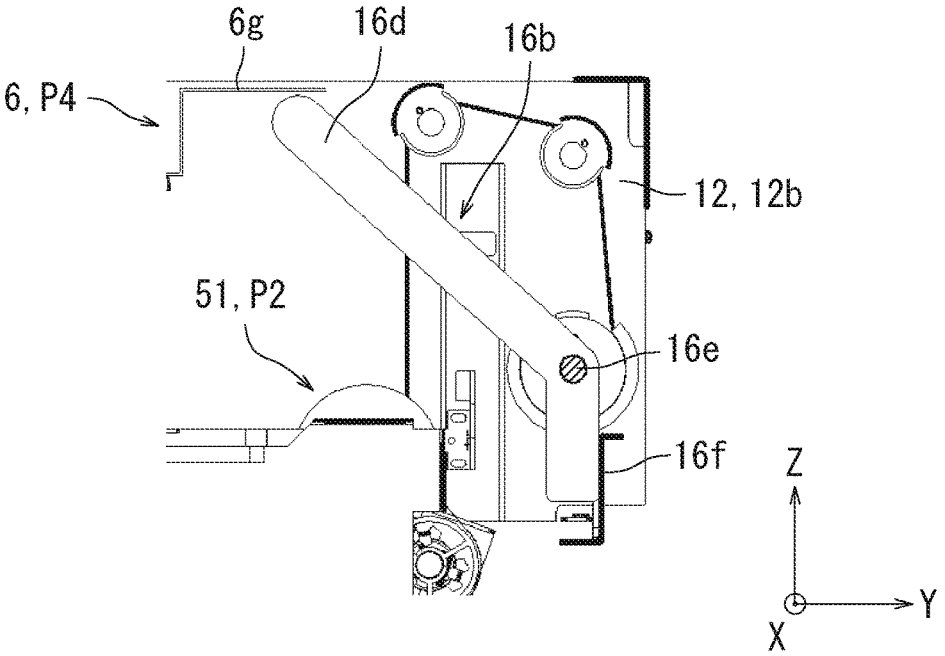
FIG. 4B is a side view illustrating the support lever section when the first conveyance unit according to the embodiment of the present disclosure is in a lower limit position.

The support lever sections 16*b* are described with reference to FIGS. 4A and 4B. FIGS. 4A and 4B are side views illustrating the support lever sections 16*b*. In detail, the first conveyance unit 51 is in the upper limit position P1 in FIG. 4A. The first conveyance unit 51 is in the lower limit position P2 and the capping unit 6 is in the standby position P4 in FIG. 4B. Note that a description of a configuration of the support lever section 16*b* toward the wall 12*a* is omitted because it is the same as a configuration of the support lever section 16*b* toward the wall 12*b*.

As illustrated in FIGS. 4A and 4B, the support lever section 16*b* includes a lever 16*d*, a rotary shaft 16*e*, and a stopper 16*f*. The rotary shaft 16*e* is pivotably supported on the wall 12*b*. The support lever section 16*b* is rotatable coaxially with the rotary shaft 16*e*. The rotary shaft 16*e*, for example, can be a drive transmission shaft included in a drive section that causes the first conveyance unit 51 to ascend or descend. The lever 16*d* is pivotably supported by the rotary shaft 16*e*. The stopper 16*f* is fixed to the wall 12*b*. Note that in the support lever section 16*b* toward the wall 12*a*, the rotary shaft 16*e* is pivotably supported by the wall 12*a*, and the stopper 16*f* is fixed to the wall 12*a*.

The lever 16*d*, for example, is urged by the weight thereof so as to rotate in one direction around the rotary shaft 16*e*. Furthermore, the rotation of the lever 16*d* is restrained by the stopper 16*f* when the lever 16*d* has rotated to a predetermined position.

The lever 16*d* rotates as the first conveyance unit 51 ascends and descends. The lever 16*d* is supported by the first conveyance unit 51 in a position illustrated in FIG. 4A when the first conveyance unit 51 is in the upper limit position P1. By contrast, the lever 16*d* rotates by the weight thereof and is supported by the stopper 16*f* in a position illustrated in FIG. 4B when the first conveyance unit 51 moves to the lower limit position P2. When the capping unit 6 has been moved into the standby position P4, the lever 16*d* illustrated in FIG. 4B supports the plate section 6*g* of the capping unit 6 from beneath.

Figure 5A:
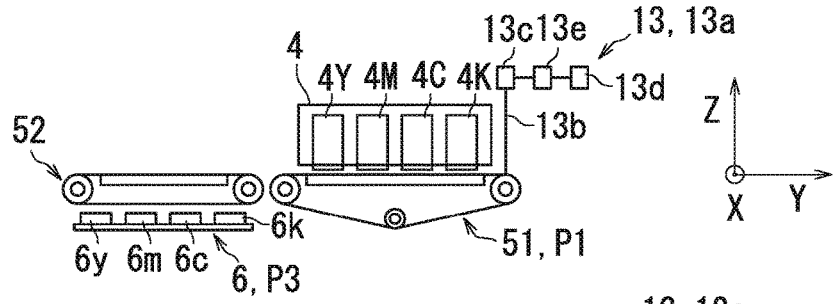
FIGS. 5A to 5E are diagrams illustrating operation of the first conveyance unit and a capping unit according to the embodiment of the present disclosure.

A configuration of the conveyance unit movement mechanism 13 is described with reference to FIG. 5A. As illustrated in FIG. 5A, the conveyance unit movement mechanism 13 includes a conveyance unit drive section 13*a*. The conveyance unit drive section 13*a* includes a wire 13*b*, a roller 13*c*, a motor 13*d*, and a clutch 13*e*. The conveyance unit drive section 13*a* is arranged in the second casing 12 described with reference to FIGS. 2 and 3.

One end of the wire 13*b* is attached to the first conveyance unit 51. The other end of the wire 13*b* is attached to the roller 13*c*. The wire 13*b* supports the first conveyance unit 51 so that the first conveyance unit 51 is suspended.

The roller 13*c* is rotatable around a rotary shaft (not shown) extending in the Y axial direction. The roller 13*c* rotates in one direction thus winding the wire 13*b*. The roller 13*c* also rotates in the other direction thus unwinding the wire 13*b*.

A drive shaft (not shown) of the motor 13*d* is connected to the rotary shaft of the roller 13*c* via the clutch 13*e*. The motor 13*d* rotates the roller 13*c* in either direction.

The clutch 13*e* switches the rotary shaft of the roller 13*c* between being connected to and disconnected from the drive shaft of the motor 13*d*.

Continuing, operation of the first conveyance unit 51 and the capping unit 6 is described with reference to FIGS. 2, 3, and 5A to 5E. FIGS. 5A to 5E are diagrams illustrating operation of the first conveyance unit 51 and the capping unit 6. FIG. 5A illustrates a state in which the first conveyance unit 51 can convey the paper S.

Figure 5B:
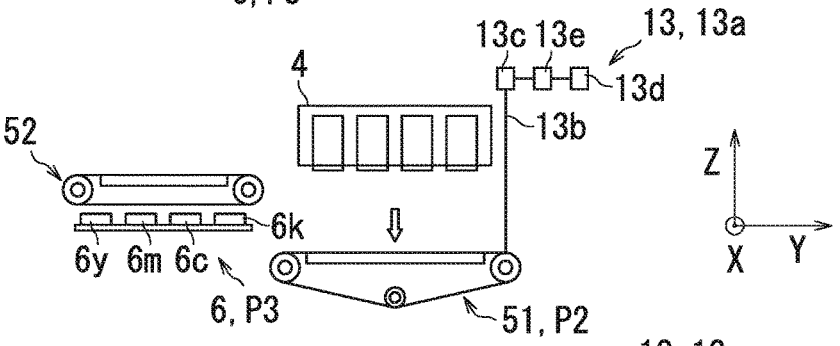

When the capping unit 6 caps ink ejection ports of the recording head section 4, the first conveyance unit 51 first descends to the lower limit position P2, as shown in FIG. 5B. In detail, the motor 13*d* drives the roller 13*c*, from which the wire 13*b* is unwound. The motor 13*d* stops after the wire 13*b* has unwound to a predetermined length. As a result, the first conveyance unit 51 descends to the lower limit position P2.

Figure 5C:
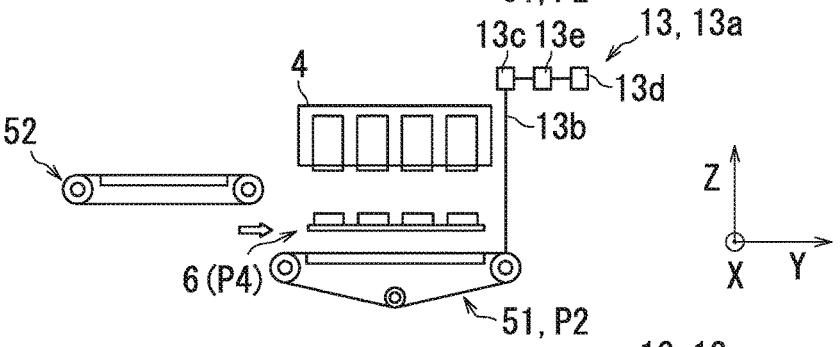

Next, the capping unit 6 moves in the Y axial direction, as illustrated in FIG. 5C. In detail, the capping unit 6 is moved along the rail section 14*a* by the capping movement mechanism 14. The capping unit 6 accordingly moves from the inside of the first casing 11 to the inside of the second casing 12. As a result, the capping unit 6 moves from the retracted position P3 to the standby position P4, facing the recording head section 4 from directly beneath.

Figure 5D:
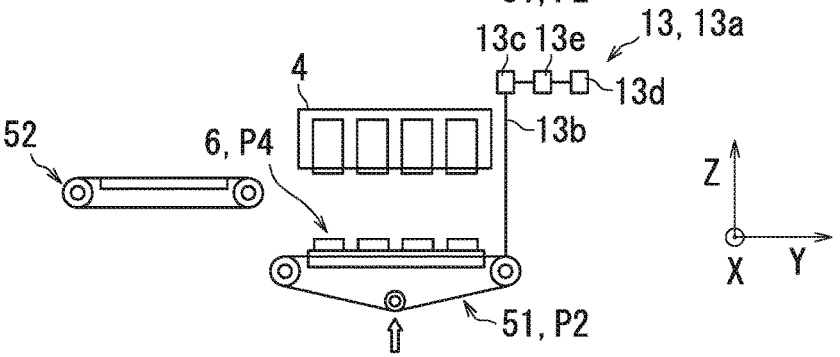

Next, as illustrated in FIG. 5D, the motor 13*d* drives the roller 13*c*, to which the wire 13*b* winds. As a result, the first conveyance unit 51 ascends from the lower limit position P2 and comes into contact with the capping unit 6.

Figure 5E:
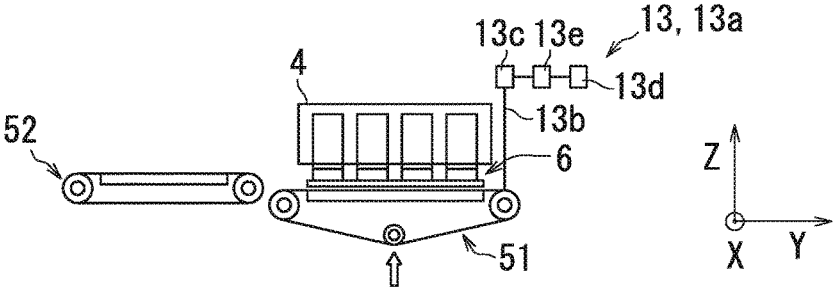

Next, as illustrated in FIG. 5E, the motor 13*d* drives the roller 13*c*, to which the wire 13*b* further winds. As a result, the capping unit 6 ascends together with the first conveyance unit 51. The motor 13*d* stops after the wire 13*b* has been wound to a predetermined length. As a result, the caps 6*y*, 6*m*, 6*c*, and 6*k* of the capping unit 6 come into contact with the recording heads 4*y*, 4*m*, 4*c*, and 4*k* of the recording head section 4, respectively. The capping unit 6 then closes the ink ejection ports of the recording head section 4.

Figure 6:
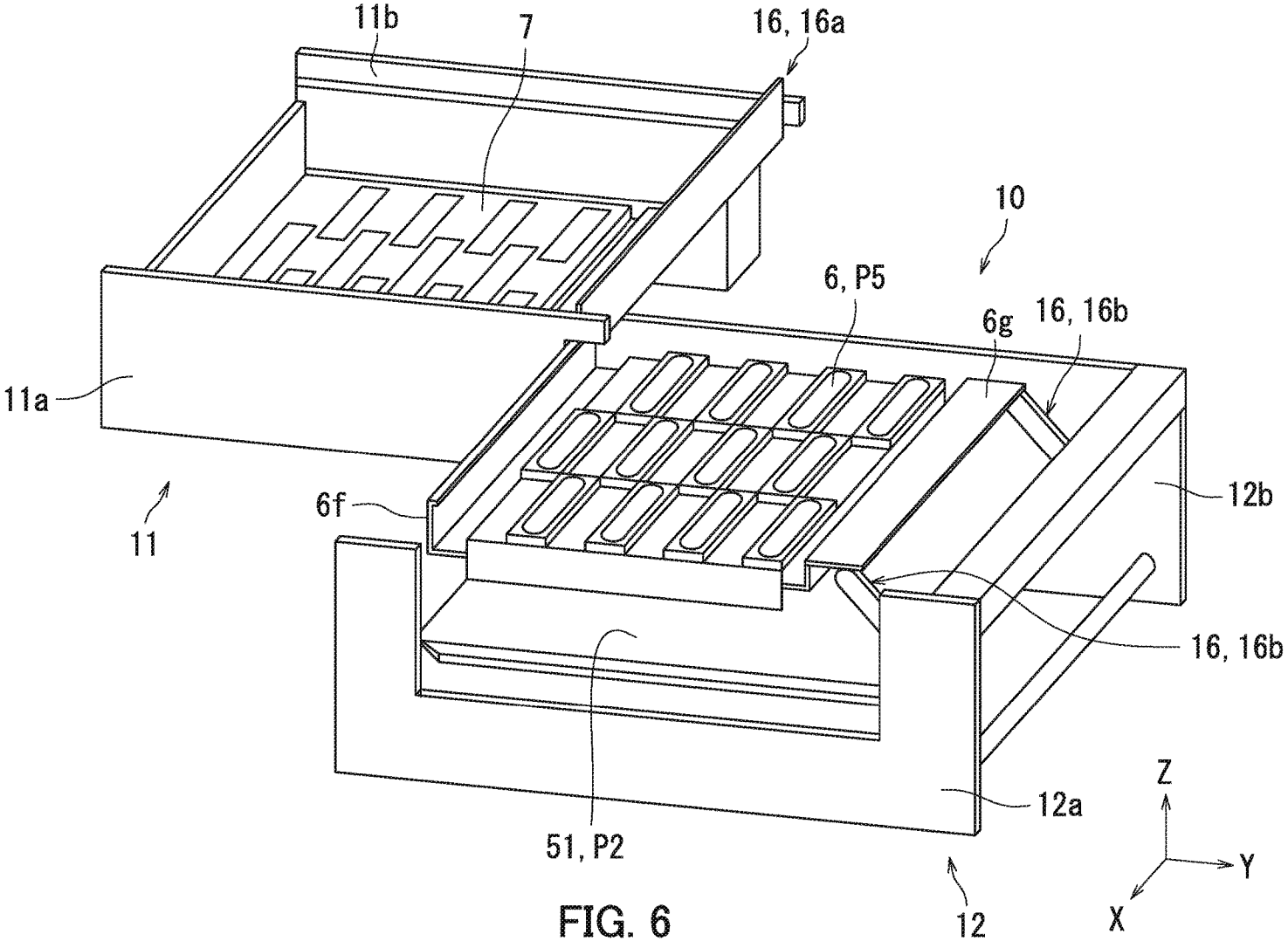
FIG. 6 is a perspective view illustrating the movement mechanism when the capping unit according to the embodiment of the present disclosure is in a detachable position.

Next, the configuration of the movement mechanism 10 is further described with reference to FIGS. 2 and 6. FIG. 6 is a perspective view illustrating the movement mechanism 10. In detail, the capping unit 6 is in a detachable position P5 in the movement mechanism 10 illustrated in FIG. 6. In the detachable position P5, the capping unit 6 can be attached or detached.

As illustrated in FIGS. 2 and 6, the second casing 12 is movable in the X axial direction. A user or a service person, for example, moves the second casing 12 in the X axial direction. When the second casing 12 moves in the X axial direction, the first conveyance unit 51 moves together with the second casing 12 in the X axial direction. The capping unit 6 also moves in the X axial direction as the second casing 12 moves in the X axial direction, when the capping unit 6 is in the standby position P4 (FIG. 2).

The rail section 16*a* extends in the X axial direction, and supports the capping unit 6 moving in the X axial direction. In detail, the rail section 16*a* supports the capping unit 6 as the capping unit 6 crosses from the standby position P4 to the detachable position P5. The detachable position P5 is outside of the casing 2 described with reference to FIG. 1. In detail, the detachable position P5 is a position that is outside of the front of the casing 2. The capping unit 6 is replaced when in the detachable position P5. Specifically, the user or the service person lifts and removes the capping unit 6 in the detachable position P5 from the capping support section 16. Afterward, a new or post-maintenance capping unit 6 is arranged in the capping support section 16.

According to the inkjet recording device 1 of the present embodiment, the capping unit 6 can be moved in the X axial direction from the standby position P4 and placed in the detachable position P5. Accordingly, the front of the casing 2 opens, and the capping unit 6 can be attached and detached. As a result, the capping unit 6 can be easily attached and detached through the front of the casing 2 without moving the inkjet recording device 1, even when a side surface of the casing 2 with the ejection section 8 thereon is up against a wall of a room. Also, the capping unit 6 can be easily attached and detached through the front of the casing 2 without removing a post-processing device from the inkjet recording device 1, even when the post-processing device has been installed in the inkjet recording device 1.

Figure 7A:
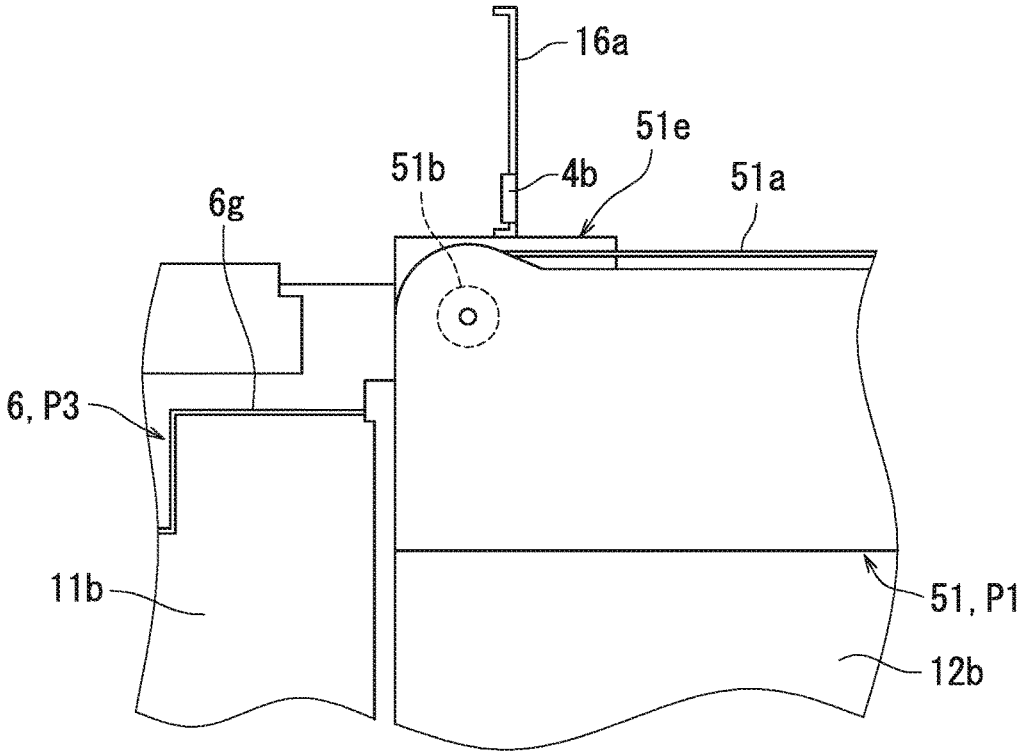
FIG. 7A is a side view illustrating a rail section when the first conveyance unit according to the embodiment of the present disclosure is in the upper limit position.
Figure 7B:
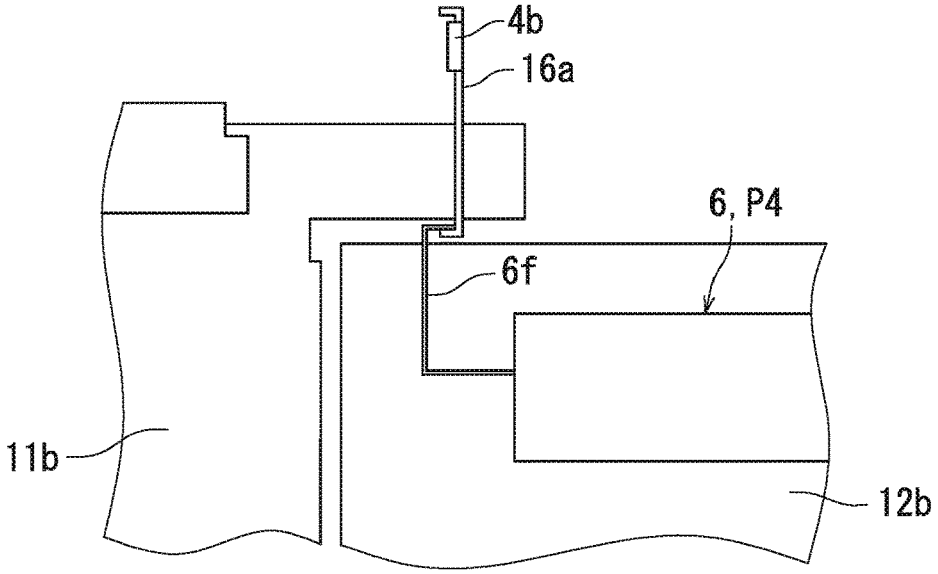
FIG. 7B is a side view illustrating the rail section when the capping unit according to the embodiment of the present disclosure is in a standby position.

Next, a configuration of the rail section 16*a* is described with reference to FIG. 7. FIG. 7 is a side view illustrating the rail section 16*a*. In detail, the first conveyance unit 51 is in the upper limit position P1 in FIG. 7A. In FIG. 7B, the capping unit 6 is in the standby position P4.

As illustrated in FIGS. 7A and 7B, the rail section 16*a* is caused to ascend or descend by the first conveyance unit 51. The recording head section 4 described with reference to FIG. 1 supports the rail section 16*a* so that the rail section 16*a* can ascend and descend, for example. The rail section 16*a*, for example, descends by the weight thereof, and ascends together with the first conveyance unit 51. In the present embodiment, the recording head section 4 further includes a retaining member 4*b*. The retaining member 4*b* is disposed on the head housing 4*a*. The retaining member 4*b* has a hollow shape. The retaining member 4*b* supports the rail section 16*a* so that the rail section 16*a* can ascend and descend.

The rail section 16*a* comes into contact with an upper end 51*e* of a frame of the first conveyance unit 51 to ascend. The upper end 51*e* of the frame of the first conveyance unit 51 is above the conveyor belt 51*a*. Therefore, the rail section 16*a* does not make contact with the conveyor belt 51*a* or the drive roller 51*b* when being caused to ascend by the first conveyance unit 51. Also, there is a predetermined space in the Z axial direction between the conveyor belt 51*a* and the upper end 51*e*. The predetermined space is larger than a thickness of the paper S. The rail section 16*a* accordingly does not make contact with the paper S conveyed by the conveyor belt 51*a* either.

The rail section 16*a* descends by the weight thereof when the first conveyance unit 51 has descended. As the rail section 16*a* descends, an upper end thereof engages the retaining member 4*b*. The rail section 16*a*, having descended, can engage the capping unit 6 that has been moved into the standby position P4. The engagement rail section 6*f* described with reference to FIG. 2 has an approximate U-shape when viewed from a side, and engages the rail section 16*a* when the capping unit 6 has been moved into the standby position P4. The engagement rail section 6*f* is slidable along the rail section 16*a*, and is supported by the rail section 16*a* when the capping unit 6 moves together with the second casing 12 in the X axial direction, as described with reference to FIG. 6.

The inkjet recording device 1 according to the embodiment of the present disclosure is described above with reference to FIGS. 1 to 7. However, the present disclosure is not limited to the present embodiment, and may be practiced in various manners within a scope not departing from the essence thereof.

For example, the capping unit 6 moves together with the second casing 12 in the X axial direction according to the embodiment of the present disclosure, but the present disclosure is not limited thereto. It is only necessary for the capping unit 6 to be moved by itself to the detachable position P5. The capping unit 6 by itself, for example, may move to the detachable position P5 along the rail section 16*a* and the support lever section 16*b* (lever 16*d*) without moving the second casing 12. As a result, the capping unit 6 can be moved between the standby and detachable positions P4 and P5 without moving the second casing 12 in the X axial direction.

Note that the drawings are schematic illustrations that emphasize elements of configuration in order to facilitate understanding thereof. Properties of the elements of configuration illustrated in the drawings, such as thicknesses and lengths thereof, may differ from actual properties thereof in order to facilitate preparation of the drawings. Also, properties of elements of configuration such as shapes described in the above embodiment are merely examples, are not intended as specific limitations, and can be altered in various ways to the extent that there is not substantial deviation from the effects of the present disclosure.

What is claimed is:

1. An inkjet recording device comprising:

a recording head section configured to form an image with ink on a recording medium;

a capping unit that includes a cap, the cap being contactable to the recording head section;

a capping movement mechanism configured to move the capping unit; and a capping support section configured to support the capping unit, wherein the capping movement mechanism includes a first horizontal guidance section configured to guide the capping unit in a first horizontal direction between a standby position in which the cap is located beneath the recording head section and a retracted position in which the cap has retracted from the standby position, and the capping support section includes a second horizontal guidance section configured to guide the capping unit in a second horizontal direction between the standby position and a detachable position in which the capping unit is attached or detached, the second horizontal direction intersecting the first horizontal direction.

2. The inkjet recording device according to claim 1 further comprising:

a conveyance section configured to convey the recording medium along a conveyance path, wherein the conveyance section includes a conveyance unit configured to ascend and descend between an upper limit position in which the conveyance unit faces the recording head section and a lower limit position in which the conveyance unit is descended from the upper limit position.

3. The inkjet recording device according to claim 2, wherein the second horizontal guidance section is capable of guiding the capping unit in the second horizontal direction when the conveyance unit is in the lower limit position.

4. The inkjet recording device according to claim 3, wherein the second horizontal guidance section ascends and descends together with the conveyance unit.

5. The inkjet recording device according to claim 2, wherein the capping support section further includes a support lever section configured to support the capping unit, and the support lever section supports the capping unit that has been moved into the standby position, when the conveyance unit is in the lower limit position.

6. The inkjet recording device according to claim 5, wherein the support lever section is rotatable coaxially with a drive transmission shaft included in a drive section that causes the conveyance unit to ascend or descend, and the support lever section rotates as the conveyance unit ascends or descends.

7. The inkjet recording device according to claim 6, wherein the support lever section includes a lever pivotably supported by the drive transmission shaft, the capping unit includes a plate section on an end thereof near the support lever section, and the lever supports the plate section from beneath when the capping unit has been moved into the standby position.

8. The inkjet recording device according to claim 7, wherein the support lever section includes a stopper, the lever rotates by the weight thereof in one direction around the drive transmission shaft, and the rotation of the lever is restrained by the stopper when the lever has rotated to a predetermined position.

9. The inkjet recording device according to claim 2, wherein the recording head section includes a retaining member supporting the second horizontal guidance section so that the second horizontal guidance section ascends and descends, and the second horizontal guidance section:

ascends together with the conveyance unit; and descends by the weight thereof to engage the retaining member when the conveyance unit descends.

* * * * *